United States Patent [19]

Iwamoto et al.

[11] Patent Number: 4,744,517

[45] Date of Patent: May 17, 1988

[54] ULTRA-HIGH-PRESSURE ROTARY WATER JET GUN

[75] Inventors: Toru Iwamoto; Eikichi Shinagawa; Takayuki Adachi, all of Tokyo, Japan

[73] Assignees: Aiko Engineering Co., Ltd.; JSE Corporation, both of Tokyo, Japan

[21] Appl. No.: 893,280

[22] Filed: Aug. 5, 1986

[30] Foreign Application Priority Data

Aug. 9, 1985 [JP] Japan ..... 60-174025

[51] Int. Cl.[4] ..... B05B 3/04; B05B 1/34; B05B 3/00

[52] U.S. Cl. ..... 239/263; 239/263.3; 239/264; 239/380

[58] Field of Search ..... 239/263, 263.3, 264, 239/380; 51/2 K, 134.5 F; 415/144, 503, DIG. 6; 417/272, 404

[56] References Cited

U.S. PATENT DOCUMENTS

| | | | |
|---|---|---|---|
| 3,885,355 | 5/1975 | Kakimoto | 51/134.5 F X |
| 4,104,008 | 8/1978 | Hoffmann et al. | 417/404 X |
| 4,125,968 | 11/1978 | Mackey | 51/134.5 F X |
| 4,369,850 | 1/1983 | Barker | 175/393 |
| 4,390,322 | 6/1983 | Budzich | 417/404 X |
| 4,534,711 | 8/1985 | Wakatsuki | 417/273 |

*Primary Examiner*—Andres Kashnikow
*Assistant Examiner*—Patrick N. Burkhart

[57] ABSTRACT

An ultra-high-pressure rotary water-jet gun capable of removing rust, scale, burrs, paint film and other unwanted deposits from the surface of metal, concrete and other materials. An air turbine serves to rotate an eccentric rotor within the gun housing. A high pressure water line passing through the rotor is connected to a nozzle head on which are mounted several nozzle tips. The nozzle head is rotated in a circular path by the eccentric rotor while directing the high pressure water jets against the work piece. A pneumatic circuit and a hydraulic circuit with certain controls are provided.

7 Claims, 7 Drawing Sheets

ULTRA-HIGH-PRESSURE ROTARY WATER JET GUN

BACKGROUND OF THE INVENTION

1. Field of the Invention

The present invention relates to an ultra-high-pressure rotary water jet gun for exfoliating rust, scale, concrete coating, burrs, paint film and other materials adhered to or formed on a surface of a metal work or a non-metal work.

2. Description of the Prior Art

In recent years, in various fields of the arts, there is employed a machining apparatus utilizing ultra-high-pressure water, which apparatus projects the ultra-high-pressure water, against the work through its jet nozzle to cut the work or to remove unwanted material present on the surface of the work or wash such material off the surface of the work, under the effect of a high-pressure and high-speed water jet fed with ultra-high-pressure water.

In a conventional type of such machining apparatus utilizing the ultra-high-pressure water, its nozzle is rotated in an orbiting manner so as to broaden its treatment area. Hitherto for example in U.S. Pat. No. 4,448,574, issued to Sachio Shimizu, there is proposed a portable type of apparatus as one of such conventional ultra-high-pressure water jet guns. In this portable type of the ultra-high-pressure water jet gun an electric motor for rotating a water jet nozzle is incorporated in the housing to which a grip is attached. However, since this type of jet gun depends on an electric power source, it has the disadvantage that electric means, including the electric motor, must be protected against water. In case that such electric means is not perfectly protected against water, there is the danger that an electric leak may occur in the apparatus. However, it is expensive to provide a perfect waterproof construction in such electrically operated equipment. In addition to these disadvantages, in the jet gun in which the electric motor is incorporated, there is another disadvantage in that the jet gun is difficult to use due to its heavy weight caused by incorporating the electric motor therein. However, a light-weight electric motor which is employed for improving the ease of use of the jet gun fails to supply sufficient power required by the jet gun, and also, such a light-weight electric motor is apt to burn out due to its overload condition if it is used continuously for a long time. These are disadvantages inherent in the conventional jet gun.

SUMMARY OF THE INVENTION

It is an object of the present invention to resolve the above disadvantages, particularly, to provide an ultra-high-pressure rotary water jet gun which is reduced in its size and weight by employing an air turbine in place of the electric motor, and has a large capacity of exfoliating, removing and washing off unwanted material present on the surface of the work by its jet action.

It is another object of the present invention to provide an ultra-high-pressure rotary water jet gun which enables an operator to control the jet gun by means of a remote control device provided in the vicinity of the operator, even when the operation of the jet gun is conducted by an operator positioned on an elevated working platform.

It is further another object of the present invention to provide an ultra-high-pressure rotary water jet gun which is provided with a pneumatic circuit for supplying pressurized air to the air turbine as its driving power source and a hydraulic circuit for supplying ultra-high-pressure water to its water jet nozzle.

It is further another object of the present invention to provide an ultra-high-pressure rotary water jet gun which is provided with an operation member which enables the operator to control both the pneumatic circuit and the hydraulic circuit simultaneously.

For accomplishing the above objects of the present invention, in the ultra-high-pressure rotary water jet gun of the present invention, a water feeding tube, to which a nozzle for projecting ultra-high-pressure water is attached, is rotatably mounted in an eccentric rotor in an eccentric position thereof, which eccentric rotor is supported in a housing of the jet gun, in which housing there is further provided an air turbine which is driven by the pressurized air to make it possible to rotatably drive the eccentric rotor so that the jet gun nozzle is rotated in an orbiting manner.

This invention provides an ultra-high-pressure rotary water jet gun comprising: a housing having a grip at rear-end thereof, an eccentric rotor mounted in said housing, a water supply tube rotatably mounted in an eccentric position with respect to the center of said eccentric rotor, a nozzle cartridge connected on a front end of said water supply tube, a hydraulic circuit for feeding said ultra-high-pressure water to said water supply tube, an actuator mounted in said housing to rotate said eccentric rotor, said actuator being an air turbine using pressurized air as its power source, said air turbine comprises a casing secured in said housing nearby said grip, said casing having an inlet port and an outlet port, a turbine rotor rotatably supported in said casing, a plurality of vanes radially fixed on said turbine rotor, a planetary gear mechanism connected to the spindle of said turbine rotor and, an output shaft provided for said gear mechanism to rotate said eccentric rotor, an intake passage for feeding the pressurized air to said turbine rotor, an exhaust passage for discharging waste air from said outlet port to the atmosphere, a control device mounted in said grip for opening and closing said intake passage, an operation member mounted on a front portion of said grip to operate said control device, and a pneumatic circuit connected to a terminal portion of said intake passage so as to feed the pressurized air to said air turbine.

The pneumatic circuit of the ultra-high-pressure rotary water jet gun is so constructed that a pilot signal issued from the pneumatic control device is simultaneously applied to both of: an unloading valve for opening and closing a water discharging passage communicating with a hydraulic pump; and a control valve for opening and closing the air inlet passage for feeding the pressurized air to the air turbine. Thus, the starting and stopping of the air turbine and the injection and stopping of the ultra-high-pressure water are controlled at the same time by means of the operation member on the grip.

The ultra-high-pressure rotary water jet gun of the present invention has the advantage that it is small and light and its nozzle is rotated with a very large torque, because the air turbine, which is driven by the pressurized air and is employed as a power source for rotating the jet nozzle at a high speed, is incorporated in a gun housing of the jet gun, said control device of the pressurized air being incorporated in the grip which is provided in a terminal portion of the above gun housing, the operation member of said control device being directly mounted on the grip. Consequently, the jet gun of the present invention can conduct the exfoliating or cleaning operation at a high speed over a wide area on the surface of the work because the rotary jet gun is easy to handle and operate, and is excellent in its portability and is excellent in its operability since it is possible to control the actuation of the air turbine and the operation of the ultra-high-pressure water jet nozzle by means of the operation member which is provided in the vicinity of the operator, even when the operator is positioned on an elevated working platform. These are advantages of the injector of the present invention.

In addition to the above, in the jet gun of the present invention, there is no requirement for provision of a waterproof means for preventing an electric leak in contrast with the conventional ultra-high-pressure water jet gun in which an electric motor in incorporated. Therefore, each part of the rotary gun of the present invention can be simplified in its construction. Since the power source is pressurized air, not electricity, it is possible to readily handle the jet gun of the present invention and without danger of an electrical accident; also, there is no concern that the electric motor will burn out, even when the jet gun is continuously operated for a long period of time. These are advantages of the jet gun of the present invention.

BRIEF DESCRIPTION OF THE DRAWINGS

The foregoing objects and advantages of the present invention will be apparent from the following description and accompanying drawings, where.

DESCRIPTION OF THE PREFERRED EMBODIMENTS

The construction of the ultra-high-pressure water jet gun of the present invention now will be described in detail with reference to the drawings.

Figure 1:
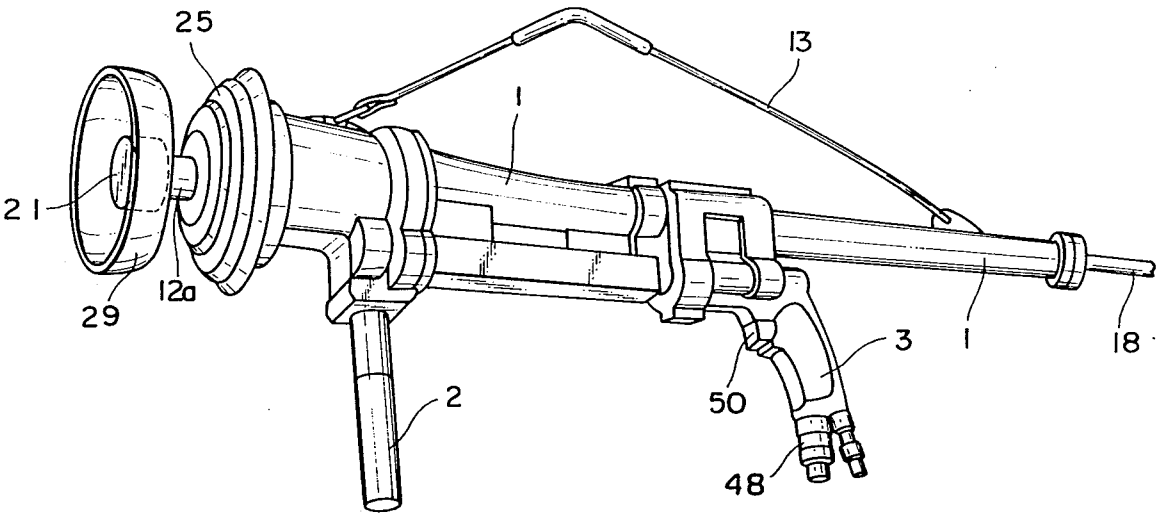
FIG. 1 is a perspective view of an embodiment of the ultra-high-pressure rotary water jet gun of the present invention.
Figure 2:
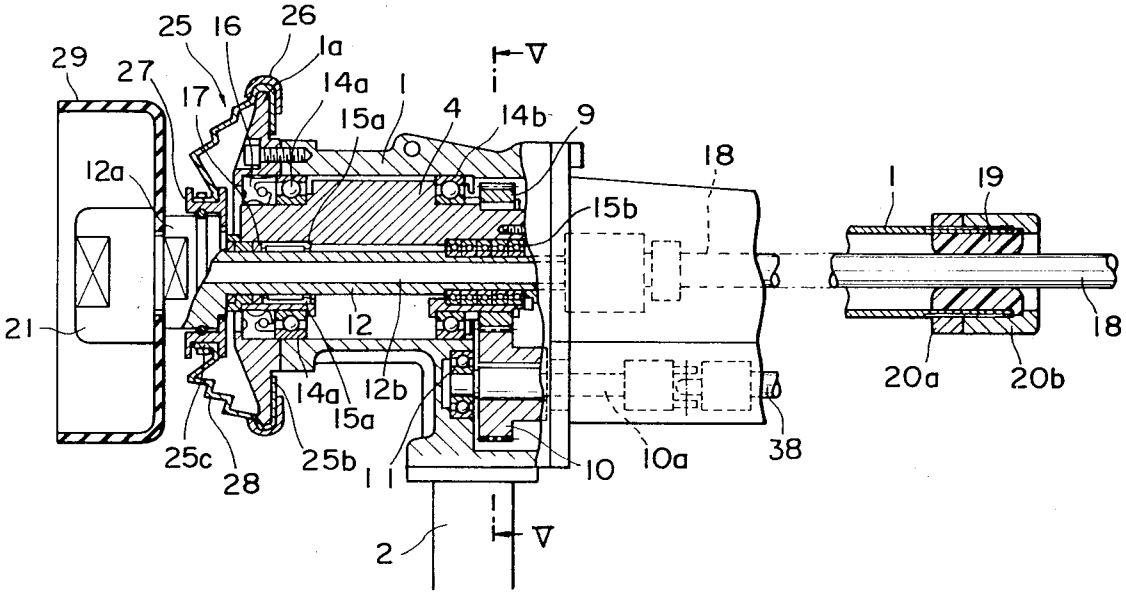
FIG. 2 is a partially broken enlarged side view of the rotary jet gun shown in FIG. 1.
Figure 3:
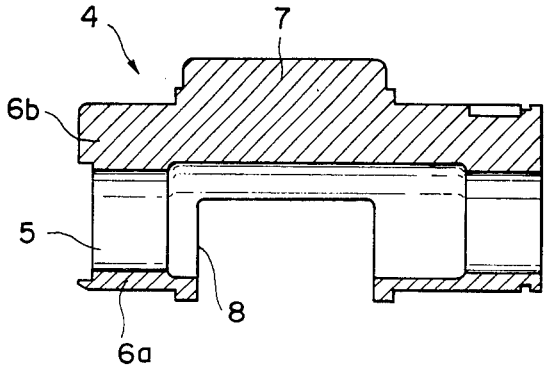
FIG. 3 is an enlarged longitudinal sectional view of an eccentric rotor of the rotary jet gun.
Figure 5:
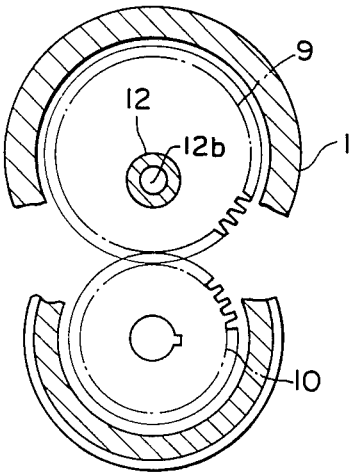
FIG. 5 is a cross-sectional view taken along the line V—V of FIG. 2.
Figure 4:
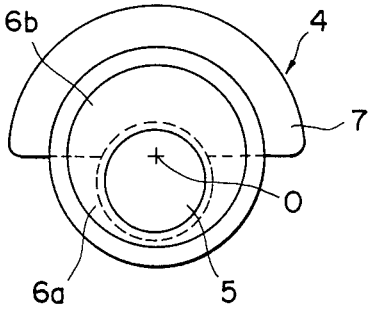
FIG. 4 is an end view of the eccentric rotor shown ih FIG. 3.

FIG. 1 shows an embodiment of the ultra-high-pressure rotary water jet gun of the present invention, wherein: the reference numeral 1 designates a laterally elongated housing of the rotary water jet gun; the numeral 2 designates a handle attached downward to a front end portion of the housing 1 of the gun; the numeral 3 designates a grip attached downward to the rear end portion of the housing 1. As shown in FIG. 2, within the housing 1 there is rotatably supported an eccentric rotor 4 through bearings 14*a*, 14*b*. Also, as shown in FIGS. 3 and 4, in the eccentric rotor 4, a hole 5 is eccentrically provided in an axial direction of the eccentric rotor 4 to deviate its center from a center "O" of the eccentric rotor 4, so that a thin wall portion 6*a* and a biased wall portion 6*b* are formed in the eccentric rotor 4. In the biased wall portion 6*b* of the eccentric rotor 4 there is formed a thick wall portion 7 which projects outward from an axially central portion of the eccentric rotor 4 to form an enlarged equal radial portion as shown in FIG. 4, while opposite to such thick wall portion 7 there is formed a notch portion 8 in the thin wall portion 6*a* of the eccentric rotor 4.

In FIG. 2, the reference numeral 9 designates a large diameter driven gear which is fixed to an outer peripheral portion of the rear end portion of the eccentric rotor 4; the numeral 10 designates a pinion meshed with the large diameter driven gear 9, which pinion 10 is supported by a bearing 11 to be driven by an air turbine 30 which is described later.

As shown in FIG. 2, in the axial hole 5 of the eccentric rotor 4 is rotatably supported a water supply tube 12, the inside of which forms a passage 12*b* for supplying the ultra-high-pressure water to the jet nozzle. The reference numeral 13 designates a shoulder string. The bearings 14*a*, 14*b* are interposed between the housing 1 and the eccentric rotor 4. The reference numerals 15*a*, 15*b* designate bearings interposed between the eccentric rotor 4 and the water supply tube 12; and the numerals 16 and 17 designate oil seals.

The reference numeral 18 designates a flexible tube or a flexible hose (hereinafter referred to as the high-pressure hose) made of a material being able to withstand a high pressure, for example such as rubber, nylon or stainless steel, which high-pressure hose 18 is connected to the rear end of the water supply tube 12 through a suitable coupling. The ultra-high-pressure water is fed to such high-pressure hose 18 from a hydraulic pump through a hydraulic circuit which is described later. The reference numeral 19 designates an elastic bushing for holding the high-pressure hose 18 in a steady condition, which bushing 19 is inserted into the terminal portion of the housing 1 of the rotary gun; the numeral 20*a* designates a lock nut; the numeral 20*b* designates a cap nut.

Figure 7:
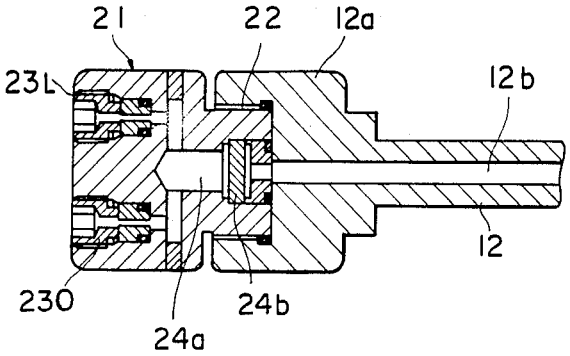
FIG. 7 is a longitudinal sectional view of a water jet nozzle cartridge attached to the rotary jet gun of the present invention.

The eccentric rotor 4 performs a continuous rotational movement in one direction through its driving means comprising; the gears 9, 10; and the air turbine 30, while the water supply tube 12 provided in an eccentric position in the eccentric rotor 4 performs a revolving movement relative to the eccentric rotor 4 in an orbiting manner around the center "O" of the eccentric rotor 4 according to the rotational movement of the eccentric rotor 4, since the water supply tube 12 is rotatably supported in the eccentric rotor 4. In this case, the water supply tube 12 does not perform a rotational movement around its central axis but performs a revolving movement around the center "O" of the eccentric rotor 4 in an orbiting manner, because the terminal portion of the water supply tube 12 is connected to the high-pressure hose 18 and held in nonrotational condition thereby. A water jet nozzle cartridge 21 is attached to a nozzle attaching portion 12*a* at the front end of the water supply tube 12 in a detachable manner through a suitable fastening means, for example a screw 22. In the front surface of the head portion of the nozzle cartridge 21, at least one nozzle tip 23 is provided. The diameter of the nozzle tip ranges from 0.05 to 0.5 mm; the nozzle tip 23 is made of an extremely hard material such as diamond or a suitable ceramic material and is connected with the passage 12*b* of the ultra-high-pressure water. Further, as shown in FIG. 7, a filter 24*b* is inserted in the water passage 24*a* in a detachable manner to prevent the nozzle tip 23 from being clogged up or being worn by particles mixed in the water flowing in the passage 12*b*.

Figure 6A:
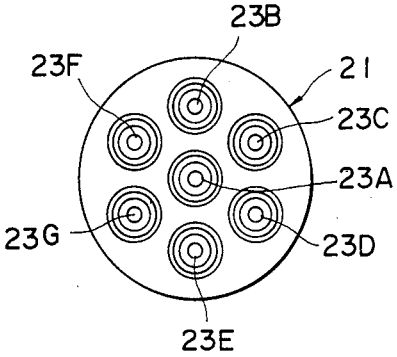
FIG. 6A and 6B are plan views showing formation patterns of the water jet nozzles of the jet gun of the present invention.
Figure 6B:
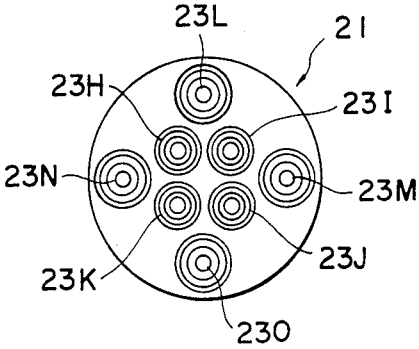

While the nozzle cartridge 21 may be provided with at least one nozzle tip 23 in the central portion of the nozzle head thereof, it is possible to provide a plurality of nozzle tips 23A,23B,23C, and others, i.e.,23A to 23O in the central portion of the nozzle head and/or in portions on several concentric circles on thefront surface of the nozzle head, which concentric circles have various radii with respect to the center of the nozzle head as shown in examples shown in FIGS. 6A and 6B.

For the rotary water-jet gun of the present invention, there are provided several kinds of the jet nozzle cartridges 21 having various patterns of the jet formation so as to enable the operator to select a suitable one of them according to the property of the material to be removed from the surface of the work, which suitable one is mounted on the nozzle attaching portion 12*a* of the water supply tube 12 in use.

As shown in FIGS. 1 and 2, a large diameter end 25*b* of a flexible and expansible cover member 25 which has a substantially cone-shaped configuration is fixed to a head plate 1*a* by means of a holder 26 in a clamping manner, which head plate 1*a* is mounted on a front end of the housing 1, while a small diameter end 25*c* of the cover member 25 is firmly attached to another holder 27 by means of a suitable attaching means such as an adhesive and a clamping band, which another holder 27 is mounted on the nozzle attachine portion 12*a* of the water supply tube 12. Such cover member 25 protects the bearings 14*a*, 14*b* and the oil seal 16 against foreign matters, said bearings 14*a* 14*b* and oil seal 16 being interposed between the eccentric rotor 4 which is a rotary member and the housing 1 which is a stationary member.

The holder 27 is subjected to a high-speed revolving action caused by the revolving movement of the eccentric rotor 4. Consequently, since it is necessary that the cover member 25 withstands such high-speed revolving action, the cover member 25 is made of a suitable material which is excellent in crack initiation resistance, for example such as rubber and plastics having hardness ranging from about 40 to 55 Hs, while provided with bellows 28 in its peripheral wall portion.

The reference numeral 29 designates a nozzle guard or shield which can be made of the same material as that of the cover member 25; nozzle guard 29 is clamped between the nozzle attaching portion 12*a* of the water supply tube 12 and the nozzle cartridge 21 which is mounted on the front end of the nozzle attaching portion 12*a*, so that the nozzle guard 29 overhangs the outer periphery of the nozzle cartridge 21 and covers the outer periphery of the nozzle cartridge 21, Although the nozzle guard 29 is shown to have a cup-like shape, it can be of any other suitable shape, such as a frustoconical shape or a simple dish-like shape. The nozzle guard 29 protects the operator against the dirt or other material and water splashed from the work under the operation of the jet gun so as to prevent such material from fouling the rotary water jet gun itself and the operator thereof, and to prevent solid material exfoliated or removed from the work from injuring the operator's hand grasping the handle 2 of the jet gun. The nozzle guard 29 is about 2.5 to 3 times as large as the nozzle cartridge 21 in diameter.

Figure 9:
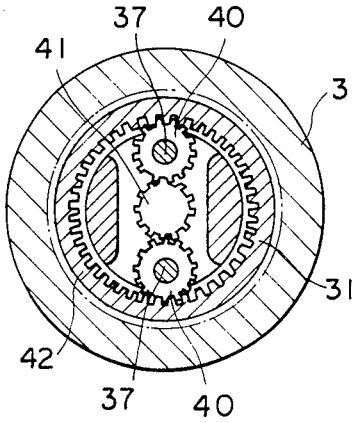
FIG. 9 is a cross-sectional view taken along the line IX—IX of FIG. 8.
Figure 10:
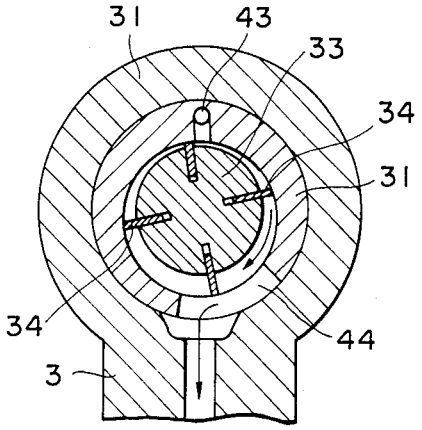
FIG. 10 is a cross-sectional view taken along the line X—X of FIG. 8.

Now, with reference to FIGS. 8 to 10, the construction of the air turbine 30, powered with pressurized air, will be described. As shown in FIG. 2, the air turbine 30 is connected to a driving shaft 10*a* of the pinion 10 through a universal joint. A turbine rotor 33 of the air turbine 30 is rotatably supported through bearings 32*a*, 32*b* in a casing 31 which forms a part of the grip 3 of the rotary jet gun of the present invention. A plurality of vanes 34 are radially mounted on the turbine rotor 33 of the air turbine 30, while to the turbine rotor 33 is concentrically fixed a spindle 35, the front end portion of which is formed into a sun gear 41. In a cap 36 provided on the end portion of the casing 31, an output shaft 38 is supported through a bearing 39, which output shaft 38 is provided with a yoke 37 which is rotatable around a central axis of the spindle 35. On each end of said yoke 37 is mounted a planetary pinion 40 which meshes with the sun gear 41 formed in the front portion of the spindle 35 and with a ring gear 42 formed in an inner surface of the casing 31, to perform its planetary motion. For example, the turbine rotor 33 is so constructed that it rotates at a high speed of 10,000 RPM which is reduced to a speed of 2,000 RPM at the output shaft 38 through the planetary gear mechanism constructed of the sun gear 41, planetary pinions 40, and the ring gear 42, to make it possible to obtain a large output torque off the output shaft 38 of the air turbine 30.

The reference numeral 43 designates an inlet port; and the numeral 44 designates an outlet port, both of which ports 43, 44 are provided in the casing 31. The inlet port 43 and the outlet port 44 are connected with a pressurized air intake passage 45 and a pressurized air exhaust port 46 respectively, both of which passages 45 and 46 are provided in the grip 3 of the rotary gun. The reference numeral 47 designates an air hose for connecting the intake passage 45 with the pressurized air source; the numeral 48 designates a silencer mounted on a lower end portion of the exhaust passage 46.

In the grip 3 of the rotary gun, there is provided an air control device 60 for controlling an intake operation of the pressurized air, the construction of which air control device 60 will be described later. The air control device 60 may be operated by means of an operation member 50 such as a lever mounted on the front portion of the grip 3, so that the air turbine 30 is controlled to initiate and stop its rotation. The reference numeral 51 designates a pivot for the lever 50; the numeral 52 designates a return spring for returning the lever 50 to its initial position; and the numeral 53 designates an actuation knob.

Figure 13:
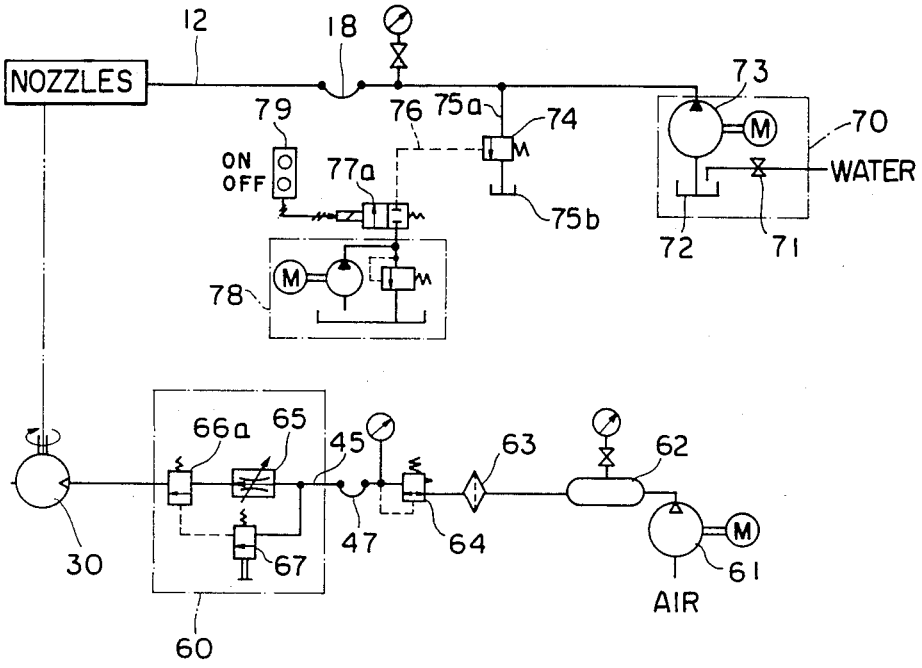
FIG. 13 is a diagram of embodiments of the pneumatic circuit and the hydraulic circuit, both of which are employed in the jet gun of the present invention.

With reference to FIG. 13, an embodiment of a pneumatic circuit and of a hydraulic circuit now will be described. The pneumatic circuit is employed in the jet gun of the present invention for supplying the pressurized air to the air turbine 30, and the hydraulic circuit is employed in the jet gun of the present invention for supplying the ultra-high-pressure water to the nozzle tips of the rotary jet gun.

In the pneumatic circuit shown in FIG. 13; the reference numeral 61 designates an air compressor; the numeral 62 designates an air reservoir; the numeral 63 designates an air filter; and the numeral 64 designates a relief type regulator, all of which are connected in series to each other and also connected to the intake passage 45 of the pressurized air, which intake passage 45 is provided in the grip 3 of the rotary jet gun, in which intake passage 45 is provided the air control device 60.

The air control device 60 is constructed of: a pressure compensated flow control valve 65, a pilot-operated control valve **66*a* and a pilot valve 67 for applying a pilot pressure to the pilot-operated control valve 66*a*. The flow control valve 65 is connected to the pilot-operated control valve 66*a* in series to be positioned in an upstream side of the control valve 66*a*, while the pilot valve 67 is connected to the control valve 66*a* in parallel. When a rod of the pilot valve 67 is pushed down by the actuation knob 53 of the lever 50, a pilot line of the pilot valve 67 is opened so that the control valve 66*a* is opened, whereby the pressurized air is fed to the air turbine 30**.

The hydraulic circuit for supplying the ultra-high-pressure water to the nozzle tips of the rotary jet gun now will be described with reference to FIG. 13. The reference numeral 70 designates an ultra-high-pressure water generating device which is constructed of: a water supplying valve 71; a storage talk 72 for storing water to a mixed liquid of water and a suitable abrasive or a suitable washing chemical therein; and a hydraulic pump 73. The reference numeral 74 designates a pilot-operated relief valve for reducing pressure and unloading; the numeral **75*a* designates a dischargine line; and the numeral 75*b* designates a discharging tank. The water or the mixed liquid supplied from the ultra-high-pressure water generating device 70 is adjusted in its pressure to a predetermined value by the relief valve 74, and then fed to the water supply tube 12 through the high-pressure hose 18**.

The reference numeral **77*a* designates a solenoid-controlled pilot-operated valve provided on an unloading circuit 76 to actuate said relief valve 74; and the numeral 78 designates a hydraulic unit constructed of a small size hydraulic pump: a relief valve and an oil tank. The reference numeral 79 designates a remote control switch for the solenoid value 77*a*. When a solenoid of the valve 77*a* is excited by actuating the remote control switch 79, the solenoid valve 77*a* is opened so that a pilot pressure is issued from a pump circuit of the hydraulic unit 78 to the relief valve 74, whereby the discharging line 75*a* is opened to perform an unloading operation. On the other hand, when the excitation of the solenoid of the valve 77*a* ceases, the solenoid valve 77*a* is closed by the resilient force of its return spring to make it possible that the relief valve 74** is shifted to its on-load side.

Figure 11:
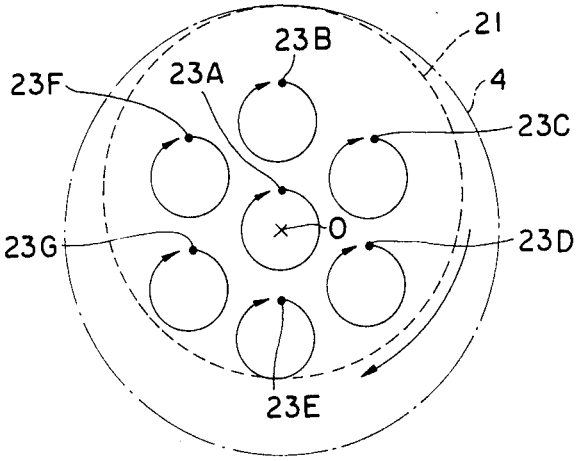
FIG. 11 is a view showing an orbiting locus of each of the jet nozzles of the rotary jet gun of the present invention in their revolving actions.

In use, the air compressor 61 and the hydraulic pump 73 are firstly actuated, and then the grip 3 of the rotary gun is grasped by the operator, for example, with the operator's right hand, while the handle 2 of the rotary gun is grasped by the operator's left hand, so that the rotary water jet gun is held steady by the operator. Then, the remote control switch 79 is manipulated so that the ultra-high-pressure water is fed to the ultra-high-pressure hose 18 from the hydraulic circuit, while the operation member 50 provided in the grip 3 of the gun is pushed down so that the pressurized air is fed to the air turbine 30 from the pneumatic circuit through the pilot valve 67 and the control valve **66*a* of the air control device, the pressure of which pressurized air is, for example, 7 $Kg/cm^2$, whereby the air turbine 30 is actuated. When the air turbine 30 is actuated, an output torque of the air turbine 30 is transmitted to the gears 9, 10 so that the eccentric rotor 4 performs a continuous circular motion in one direction. Since the water supply tube 12 is rotatably mounted in the eccentric rotor 4, the nozzle cartridge 21 revolves around the center "O" of the eccentric rotor 4 according to the rotational motion of the eccentric rotor 4. In this case, since the high-pressure hose 18, attached to the water supply tube 12, is fixed to an end portion of the housing 1 of the rotary jet gun, the water supply tube 12 is not rotated on its central axis but rotates in an orbiting manner. Consequently, there is no fear that the high-pressure hose 18 is twisted. The ultra-high-pressure water fed through the hose 18 is projected through the nozzle unit 23 provided in the nozzle cartridge 21. When the water supply tube 12 is rotated in the above-mentioned manner, the nozzle cartridge 21 itself is also rotated in an orbiting manner, so that the nozzle tips 23A, 23B, etc., project the ultra-high-pressure water while rotating in an orbiting manner, for example as shown in FIG. 11**, tracing their circular orbits.

In the jet gun of the present invention, the pressure of the water fed to each nozzle tip is in a range from 800 to 5000 $Kg/cm^2$, preferably 1000 to 3000 $Kg/cm^2$, while the speed of rotation of the nozzle of the jet gun is in a range of from 800 to 4000 RPM, preferably in a range of from 1000 to 2500 RPM. The injection rate of the water per nozzle is in a range of from 0.1 to 4.3 l/min.,preferably from 0.2 to 3.0 l/min.

Figure 12:
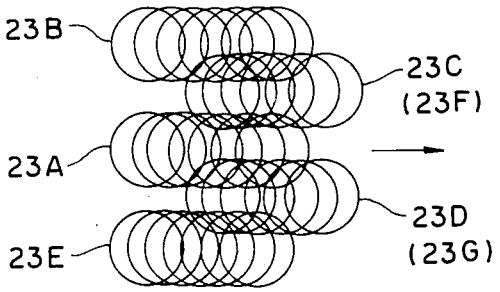
FIG. 12 is a view showing an orbiting locus of each of the jet nozzles shown in FIG. 11 in their revolving actions when the rotary jet gun is laterally moved.

When the rotary jet gun is brought close to the work and its nozzle head is moved laterally along the work while projecting the ultra-high-pressure water against the surface of the work, the nozzle jets of the rotary gun trace their orbits as shown in FIG. 12 to make it possible that the ultra-high-pressure water can be uniformly impinged over a wide area of the work, so that it is possible to perform a high-speed washing/exfoliating operation over the whole surface of the work with the use of a small amount of water.

Adjusting of the rotational speed of the air turbine 30 is performed by adjusting the regulator 64, while adjustment of the discharge pressure of the ultra-high-pressure water is performed by adjusting the relief valve 74.

Figure 14:
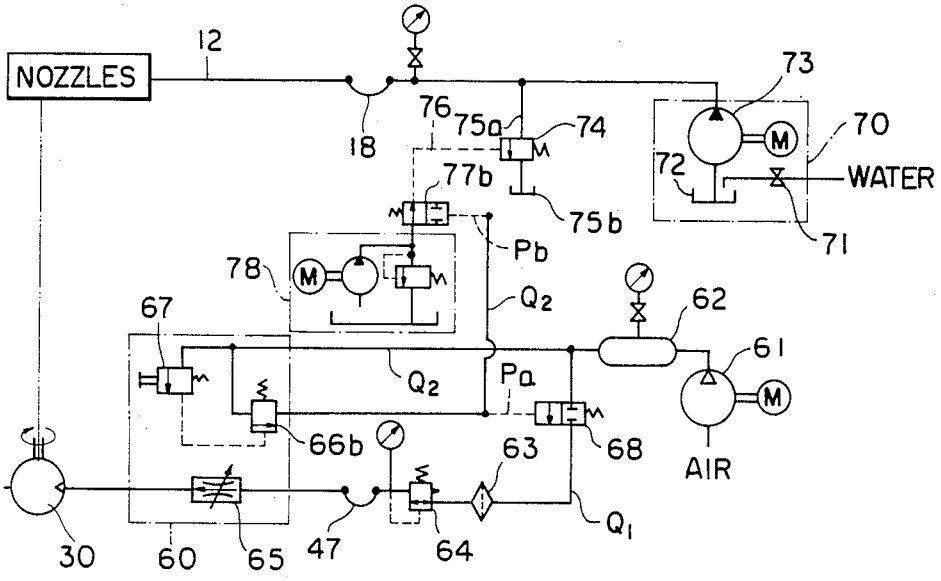
FIG. 14 is a diagram of another embodiment of the pneumatic circuit and of the hydraulic circuit shown in FIG. 13.

Next, another embodiment of the pneumatic circuit and the hydraulic circuit employed in the jet gun of the present invention will be described with reference to FIG. 14 in which is shown a pneumatic circuit. The pneumatic circuit enables the operator to simultaneously control the starting and stopping of the air turbine 30 and the injection and starting and stopping of the ultra-high-pressure water. In the circuit shown in FIG. 14, some components thereof are similar to those of the circuit shown in FIG. 13, and therefore said similar components of the circuit of FIG. 14 are designated by the same reference numerals as those in the circuit of FIG. 13. The circuit shown in FIG. 14 is different from that of FIG. 13 in that; in the circuit of FIG. 14, a pilot-operated master valve 68 is provided in a main air circuit $Q_1$ to perform the opening/closing operation of the circuit $Q_1$ which connects the air turbine 30 with the air compressor 61, while a control air circuit $Q_2$ is also provided in addition to the circuit $Q_1$, through which circuit $Q_2$ the pilot pressure is simultaneously applied to both of the master valve 68 and a pilot-operated directional control valve 77*b* for opening and closing the discharging line 75*a* of the ultra-high-pressure water generating device to perform its unloading operation. Hereinbelow, the components of the circuit of FIG. 14, different from those of the circuit of FIG. 13, will be described in detail. The reference numeral 66*b* designates a pilot-operated control valve for opening and closing the control air circuit $Q_2$. The control valve 66B is actuated in combination with the actuation of the pilot valve 67 which is actuated by the operation member 50 such as the lever. The air control device 60 is constructed of the control valve 66*b*, the pilot valve 67 and the flow control valve 65. Between the control air circuit $Q_2$ and the master valve 68 there is provided a first pilot line Pa which applies the pilot pressure to the master valve 68 to open the same 68 against a resilient force of the return spring of the master valve 68. The reference numeral 77*b* designates a pilot-operated directional control valve for opening and closing the unloading circuit 76 of the ultra-high-pressure water generating device. Between the control valve 77*b* and the control air circuit $Q_2$, there is provided a second pilot line Pb which applies the pilot pressure to the control valve 77*b* for opening the same 77*b* against a resilient force of a return spring of the control valve 77*b*.

In the circuit shown in FIG. 14, since the control valve 66*b* is opened when the pilot valve 67 is manipulated by the operation member 50, the pilot pressure is applied to the master valve 68 through the first pilot line Pa so that the master valve 68 is opened. As a result, the pressurized air is fed to the air turbine 30 from the air compressor 61 through the main air circuit $Q_1$ so that the air turbine 30 is actuated. At this time, the pilot pressure is applied to the control valve 77*b* in the unloading circuit 76 provided in the hydraulic circuit through the second pilot line Pb, so that the relief valve 74 is shifted to its closing side, whereby the ultra-high-pressure water is fed to the nozzle tips of the rotary gun from the hydraulic pump 73.

Figure 15:
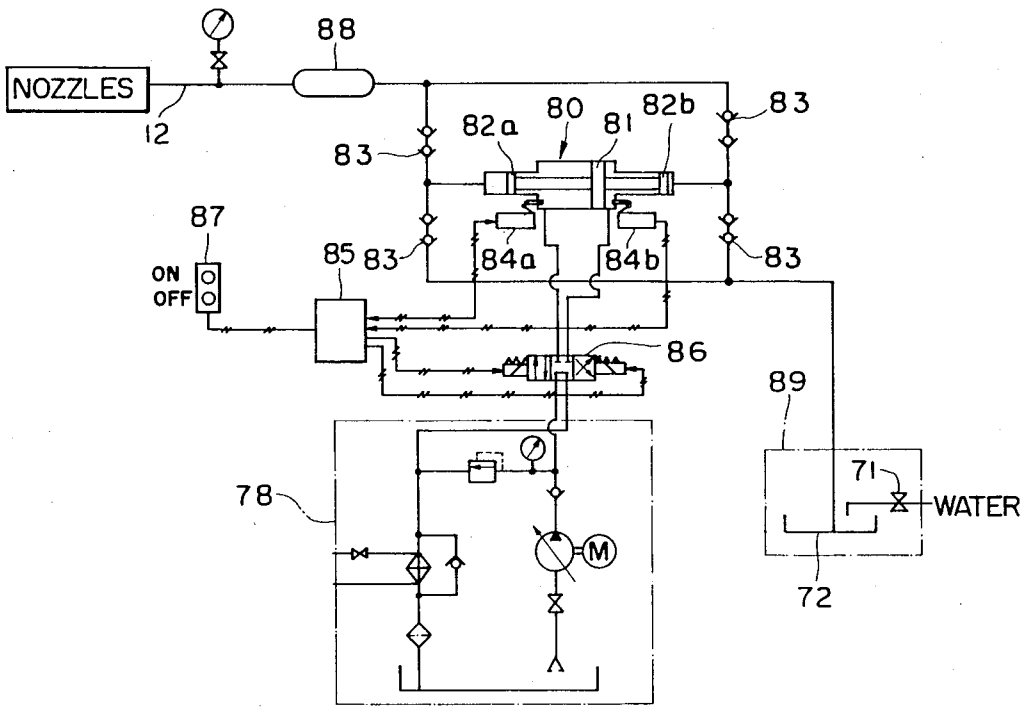
FIG. 15 is a diagram of a modification of the hydraulic circuit shown in FIG. 13.

FIG. 15 shows another embodiment of the hydraulic circuit of the jet gun of the present invention, wherein components similar to those of the hydraulic circuit of FIG. 13 are designated by the same reference numerals as that employed in the hydraulic circuit shown in FIG. 13. The hydraulic circuit of FIG. 15 is different from that of FIG. 13 in the following points. In FIG. 15, 80 designates a reciprocating type piston pump in which 81 designates a low pressure piston provided in a central portion of the piston pump 80, while 82*a*, 82*b* designate high-pressure pistons which are opposite to each other and positioned in opposite end portions of the piston pump 80. The high-pressure pistons 82*a*, 82*b* are received in high-pressure cylinder portions of the piston pump 80, to which high-pressure cylinder portions are supplied a low-pressure water from a water supplying unit 89, from which high-pressure cylinder portions the ultra-high-pressure water is fed to an accumulator 88 through appropriate lines shown in FIG. 15, in each of which lines are interposed check valves 83 to prevent the ultra-high-pressure water flowing into the low-pressure lines at a time when a suction/discharging operation of the piston pump 80 is conducted. The low-pressure piston 81 of the hydraulic pump 80 is driven in a reciprocating manner by the pressurized oil fed from the hydraulic unit 78. The driving direction of low-pressure piston 81 is controlled by a solenoid-controlled pilot-operated valve 86 which is controlled in an on/off manner by a signal issued from the remote control switch 87, while the shifting operation of the piston pump 80 is performed by signals issued from two limit switches 84*a*, 84*b* which are provided in stroke end positions of the low-pressure piston 81 of the hydraulic pump 80.

In the above circuit, according to the reciprocating motion of the low-pressure piston 81 of the pump 80, one of the opposite high-pressure pistons 82*a*, 82*b* sucks the low-pressure water while the other of the opposite high-pressure pistons 82*a*, 82*b* discharges the ultra-high-pressure water to the accumulator 88 from which the ultra-high-pressure water is fed to the nozzle tips of the rotary gun. The accumulator 88 eliminates pulsation of the ultra-high-pressure water discharged from the piston pump 80.

Figure 8:
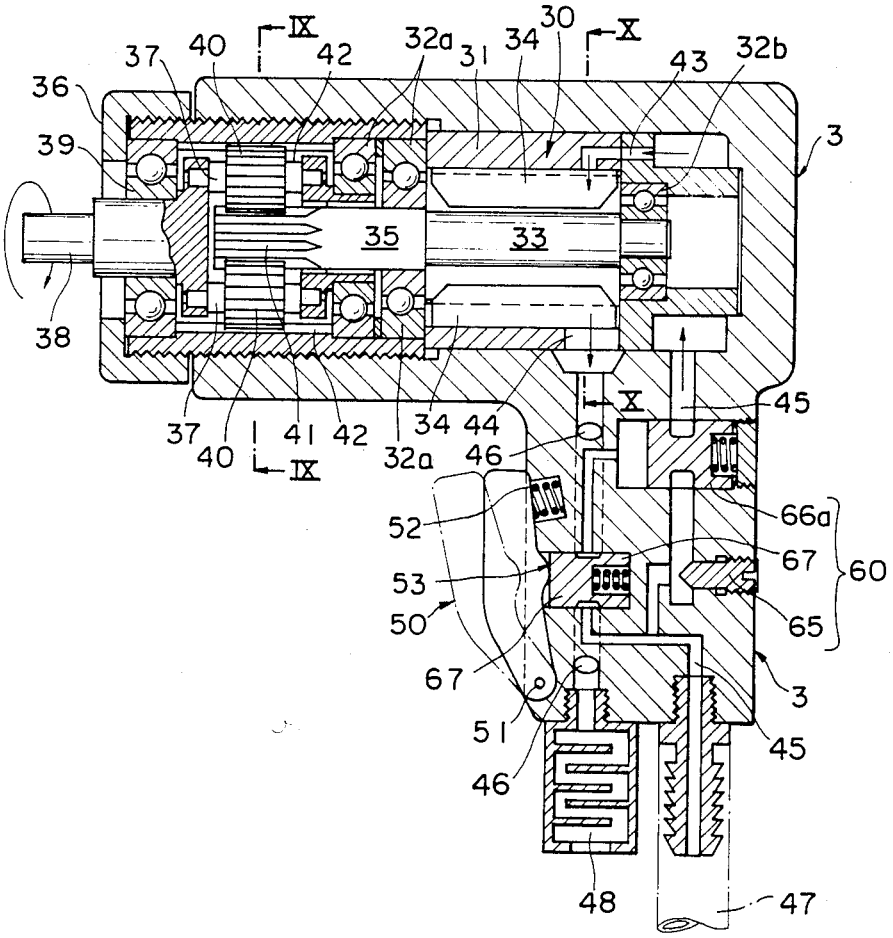
FIG. 8 is a longitudinal sectional view of an air turbine incorporated in the housing of the jet gun and the grip thereof.
Figure 16:
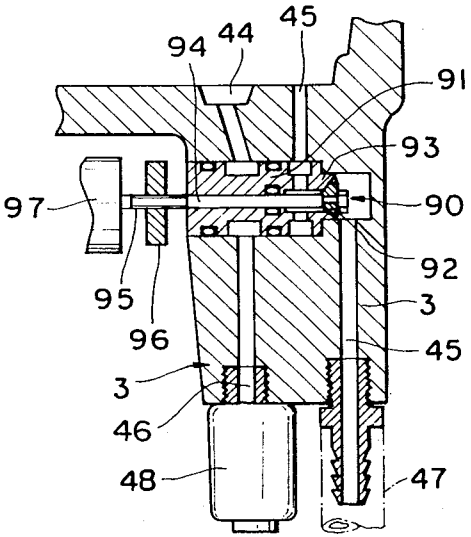
FIG. 16 is a longitudinal sectional view of the grip in which a poppet valve and a trigger are incorporated.

Although, in the air control device 60 of the embodiment of the present invention shown in FIG. 8, the air intake passage 45 is opened and closed by the pilot valve 67 operated by the operation lever 50 and the separate control valve 66*a*, it is possible to employ the following construction as shown in FIG. 16 in place thereof. In the construction shown in FIG. 16 a poppet valve 90 is employed to make it possible that the air intake passage 45 is closed and opened without using the pilot valve 67 and the control valve 66*a*, while it is also possible to controlthe flow rate of the water. The poppet valve 90 has the following construction, wherein; the reference numeral 91 designates a poppet valve body which is provided with a valve element 92 in a direction in which the pressurized air flows, which valve element 92 is seated on and separated from its valve seat 93 by means of a rod 94 which is slidably mounted on a central portion of the valve body 91, and a trigger 97 attached to an end of rod 94 for slidably pushing down the rod 94 in its longitudinal direction. Behind the trigger 97, the end of the rod 94 is threaded to form an adjusting screw 95 for regulating the amount of the pressurized air by adjusting a clearance between the valve element 92 and the valve seat 93, on which adjusting screw 95 is screwed a throttle adjusting nut 96.

In the poppet valve 90 having the foregoing construction, when the trigger 97 is pushed down by the operator's finger, the poppet valve 90 is opened so that the pressurized air is fed to the air turbine 30, while the poppet valve 90 is closed under the effect of the pressurized air when the trigger is released from the operator's finger.

While there has been shown and described the fundamental novel features of the present invention as applied to its preferred embodiments, it will be understood that various omissions, substitutions and changes in the form and details of the rotary water jet gun of the present invention illustrated may be made by those skilled in the art without departing from the spirit of the present invention. It is the intention therefore to be limited only by the scope of the following claims and reasonable equivalents thereof.

What is claimed is:

1. An ultra-high-pressure rotary water jet gun comprising:

a housing having a grip at the rear-end thereof, an eccentric rotor mounted in said housing, a water supply tube rotatably mounted in an eccentric position with respect to the center of said eccentric rotor, a nozzle cartridge carrying one or more nozzle tips connected on the front end of said water supply tube, a hydraulic circuit for supplying ultra-high-pressure water to said water supply tube, an actuator mounted in said housing to rotate said eccentric rotor, said actuator being an air turbine using pressurized air as its power source, said air turbine comprises a casing secured in said housing nearby said grip, said casing having an inlet port and an outlet port, a turbine rotor rotatably supported in said casing and having a spindle extending therefrom, a plurality of vanes radially fixed on said turbine rotor, a planetary gear mechanism connected to said spindle of said turbine rotor and, an output shaft provided to said gear mechanism to rotate said eccentric rotor, an intake passage for feeding the pressurized air to said turbine rotor, an exhaust passage for discharging waste air from said outlet port to the atmosphere, an air control device mounted in said grip for opening and closing said intake passage, said air control device consists of a pilot valve mounted in said exhaust passage and in operative relation to the actuation of said operation member and a control valve mounted in said intake passage which is controlled by said pilot valve in a switching manner to open and close said intake passage, an operation member mounted on a front portion of said grip to operate said air control device, and a pneumatic circuit connected to a terminal portion of said intake passage so as to feed the pressurized air to said air turbine.

2. An ultra-high-pressure rotary water jet gun comprising:

a housing having a grip at the rear-end thereof, an eccentric rotor mounted in said housing, a water supply tube rotatably mounted in an eccentric position with respect to the center of said eccentric rotor, a nozzle cartridge carrying one or more nozzle tips connected on the front end of said water supply tube, a hydraulic circuit for supplying ultra-high-pressure water to said water supply tube, an actuator mounted in said housing to rotate said eccentric rotor, said actuator being an air turbine using pressurized air as its power source, said air turbine comprises a casing secured in said housing nearby said grip, said casing having an inlet port and an outlet port, a turbine rotor rotatably supported in said casing and having a spindle extending therefrom, a plurality of vanes radially fixed on said turbine rotor, a planetary gear mechanism connected to said spindle of said turbine rotor and, an output shaft provided to said gear mechanism to rotate said eccentric rotor, an intake passage for feeding the pressurized air to said turbine rotor, an exhaust passage for discharging waste air from said outlet port to the atmosphere, an air control device mounted in said grip for opening and closing said intake passage, said air control device further includes a poppet valve body inserted in a crosswise direction to said intake passage, a valve rod movably mounted in said valve body, a valve seat formed in the end of said valve body within said intake passage, a poppet valve element adjacent to said valve seat at the end of said valve rod, and an adjusting screw on said valve rod for adjusting the clearance of said poppet valve, an operation member mounted on a front portion of said grip to operate said air control device, and a pneumatic circuit connected to a terminal portion of said intake passage so as to feed the pressurized air to said air turbine.

3. An ultra-high-pressure rotary water jet gun comprising:

a housing having a grip at the rear-end thereof, an eccentric rotor mounted in said housing, a water supply tube rotatably mounted in an eccentric position with respect to the center of said eccentric rotor, a nozzle cartridge carrying one or more nozzle tips connected on the front end of said water supply tube, a hydraulic circuit for supplying ultra-high-pressure water to said water supply tube, an actuator mounted in said housing to rotate said eccentric rotor, said actuator being an air turbine using pressurized air as its power source, said air turbine comprises a casing secured in said housing nearby said grip, said casing having an inlet port and an outlet port, a turbine rotor rotatably supported in said casing and having a spindle extending therefrom, a plurality of vanes radially fixed on said turbine rotor, a planetary gear mechanism connected to said spindle of said turbine rotor and, an output shaft provided to said gear mechanism to rotate said eccentric rotor, an intake passage for feeding the pressurized air to said turbine rotor, an exhaust passage for discharging waste air from said outlet port to the atmosphere, an air control device mounted in said grip for opening and closing said intake passage, an operation member mounted on a front portion of said grip to operate said air control device, a pneumatic circuit connected to a terminal portion of said intake passage so as to feed the pressurized air to said air turbine, and a substantially conical flexible guard member, provided with bellows around its periphery, being clamped between the front end portion of said housing and the front end portion of said water supply tube.

4. An ultra-high-pressure rotary water jet gun comprising:

a housing having a grip at the rear-end thereof, an eccentric rotor mounted in said housing, said eccentric rotor for rotating said water supply tube in an orbiting manner being provided with an axial hole for receiving said water supply tube so that a thin wall portion and a biased wall portion are formed in said eccentric rotor and in the axially central portion of an outer periphery of said biased wall portion there is formed a thick wall portion to be projected outward so that an outermost periphery of said thick wall portion has an equal radius with respect to the center of said eccentric rotor, while a notch portion is provided in said thin wall portion, a water supply tube rotatably mounted in an eccentric position with respect to the center of said eccentric rotor, a nozzle cartridge carrying one or more nozzle tips connected on the front end of said water supply tube, a hydraulic circuit for supplying ultra-high-pressure water to said water supply tube, an actuator mounted in said housing to rotate said eccentric rotor, said actuator being an air turbine using pressurized air as its power source, said air turbine comprises a casing secured in said housing nearby said grip, said csaing having an inlet port and an outlet port, a turbine rotor rotatably supported in said casing and having a spindle extending therefrom, a plurality of vanes radially fixed on said turbine rotor, a planetary gear mechanism connected to said spindle of said turbine rotor and, an output shaft provided to said gear mechanism to rotate said eccentric rotor, an intake passage for feeding the pressurized air to said turbine rotor, an exhaust passage for discharging waste air from said outlet port to the atmosphere, an air control device mounted in said grip for opening and closing said intake passage, an operation member mounted on a front portion of said grip to operate said air control device, and a pneumatic circuit connected to a terminal portion of said intake passage so as to feed the pressurized air to said air turbine.

5. An ultra-high-pressure rotary water jet gun comprising:

a housing, an eccentric rotor rotatably mounted therein and having an axial hole formed in said rotor in an eccentric position with respect to the center of said rotor, a water supply tube rotatably mounted in said axial hole, a nozzle cartridge for projecting ultra-high-pressure water mounted on the front end of said water supply tube, a hydraulic circuit connected to the rear end of said water supply tube for feeding ultra-high-pressure water to said nozzle cartridge, said hydraulic circuit being provided with an unloading circuit which is provided with a pilot-operated directional control valve for controlling a discharging line in an opening and closing manner, an air turbine mounted in said housing, a pneumatic circuit including pressurized air generating means which feeds pressurized air to said air turbine, and an output shaft of said air turbine connected to said eccentric rotor to rotate the same, characterized in that said pneumatic circuit is provided with;

a main air circuit for connecting said air turbine with said pressurized air generating means, a pilot-operated master valve interposed in said main air circuit, and a control air circuit branched off from said pneumatic circuit through which said master valve is connected with said pressurized air generating means, which control air circuit comprises;

a first pilot line for sending a pilot signal to said master valve; and, a second pilot line for sending said pilot signal to said control valve.

6. The ultra-high-pressure rotary water jet gun as set forth in claim 5, wherein said control air circuit is so constructed that said pilot signal is applied to said master valve and said control valve through said air control device which is actuated by said operation member.

7. The ultra-high-pressure rotary water jet gun as set forth in claim 5, wherein said air control device comprises;

a pilot valve actuated in combination with said operation member, and a control valve operated by said pilot valve.

* * * * *